US010577701B2

(12) United States Patent
Bae et al.

(10) Patent No.: US 10,577,701 B2
(45) Date of Patent: Mar. 3, 2020

(54) HETERO JUNCTION COMPOSITE AND PREPARATION METHOD THEREOF

(71) Applicant: RESEARCH & BUSINESS FOUNDATION SUNGKYUNKWAN UNIVERSITY, Suwon-si, Gyeonggi-do (KR)

(72) Inventors: Changdeuck Bae, Suwon-si (KR); Hyunjung Shin, Suwon-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 8 days.

(21) Appl. No.: 15/940,417

(22) Filed: Mar. 29, 2018

(65) Prior Publication Data

US 2018/0282886 A1 Oct. 4, 2018

(30) Foreign Application Priority Data

Apr. 3, 2017 (KR) ..... 10-2017-0043163

(51) Int. Cl.

| | |
|---|---|
| ***H01B 1/06*** | (2006.01) |
| ***C25B 11/04*** | (2006.01) |
| ***C25B 1/02*** | (2006.01) |

(52) U.S. Cl.

CPC ..... *C25B 11/0478* (2013.01); *C25B 1/02* (2013.01); *C25B 11/0405* (2013.01); *H01B 1/06* (2013.01)

(58) Field of Classification Search

CPC ... C25B 11/0405; C25B 11/0478; C25B 1/02; H01B 1/06

See application file for complete search history.

(56) References Cited

U.S. PATENT DOCUMENTS 9,899,214 B1 * 2/2018 Liang ..... H01L 21/02614

FOREIGN PATENT DOCUMENTS

KR 20140115723 A * 10/2014 ..... H01L 21/02381
KR 10-1500944 B1 3/2015

OTHER PUBLICATIONS

Bae et al., "Bulk layered heterojunction as an efficient electrocatalyst for hydrogen evolution", Science Advances, 2017, vol. 3: e1602215, pp. 1-10.

* cited by examiner

*Primary Examiner* — Mark Kopec
*Assistant Examiner* — Jaison P Thomas
(74) *Attorney, Agent, or Firm* — NSIP Law

(57) ABSTRACT

The present disclosure relates to a heterojunction composite including: a chalcogenide metal compound dispersed on a substrate, and all or a part of the substrate is chalcogenized in the same manner as the chalcogenide metal compound.

4 Claims, 10 Drawing Sheets

HETERO JUNCTION COMPOSITE AND PREPARATION METHOD THEREOF

CROSS-REFERENCE TO RELATED APPLICATION

This application claims the benefit of Korean Patent Application No. 10-2017-0043163 filed on Apr. 3, 2017, the disclosures of which are incorporated herein by reference.

TECHNICAL FIELD

The present disclosure relates to a heterojunction composite and a method of preparing the same.

BACKGROUND

A material formed of two or more different materials or phases into a complex is referred to as a composite material. However, in the case where a material is formed of two materials simply agglomerated with pores, the properties of a composite material cannot be expressed, and, thus, it cannot be referred to as a composite material. If materials or phases forming a composite material are in the range of from 100 nm to 1000 nm, the composite material is referred to as a nanocomposite material.

Conventionally, a heat treatment has been necessary to form a nanocomposite material in which an anisotropic material is uniformly dispersed within a base material. However, the properties of the anisotropic material have been nullified during the heat treatment, and, thus, it has been difficult to prepare a desired nanocomposite material.

Meanwhile, chalcogen compounds such as metal-chalcogen compounds have a common crystal structure with high electrical, magnetic, and optical anisotropy and show various unique properties. Conventionally, explanations and applications of their properties have drawn attention.

Korean Patent No. 10-1500944, which is the background technology of the present disclosure, relates to a method for growing 2D layer of chalcogenide compound, a method for preparing a CMOS type structure, a layer of chalcogenide compound, an electronic device including the layer of chalcogenide compound, and a CMOS type structure. However, this prior art document does not describe a material in which an anisotropic compound is dispersed within an isotropic compound.

SUMMARY

In view of the foregoing, the present disclosure provides a heterojunction composite and a method of preparing the same.

However, problems to be solved by the present disclosure are not limited to the above-described problems. There may be other problems to be solved by the present disclosure.

According to a first aspect of the present disclosure, there is provided a heterojunction composite including: a chalcogenide metal compound dispersed on a substrate, and all or a part of the substrate is chalcogenized in the same manner as the chalcogenide metal compound.

According to an embodiment of the present disclosure, the chalcogenide metal compound may include an anisotropic material, but may not be limited thereto.

According to an embodiment of the present disclosure, the substrate may include an isotropic material, but may not be limited thereto.

According to an embodiment of the present disclosure, the substrate may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

According to an embodiment of the present disclosure, the chalcogenide metal compound may include a chalcogen selected from the group consisting of S, Se, Te, and combinations thereof, but may not be limited thereto.

According to an embodiment of the present disclosure, the chalcogenide metal compound may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

According to a second aspect of the present disclosure, there is provided a method of preparing a heterojunction composite, including: supplying a chalcogenide precursor-containing source and a metal precursor-containing source onto a substrate; and chalcogenizing the substrate, and a chalcogen compound is dispersed within the substrate.

According to an embodiment of the present disclosure, the chalcogenide metal compound may include an anisotropic material, but may not be limited thereto.

According to an embodiment of the present disclosure, the substrate may include an isotropic material, but may not be limited thereto.

According to an embodiment of the present disclosure, the substrate may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

According to an embodiment of the present disclosure, the chalcogenide precursor-containing source may include a chalcogen selected from the group consisting of S, Se, Te, and combinations thereof, but may not be limited thereto.

According to an embodiment of the present disclosure, the metal precursor-containing source may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

The above-described embodiments are provided by way of illustration only and should not be construed as liming the present disclosure. Besides the above-described embodiments, there may be additional embodiments described in the accompanying drawings and the detailed description.

Effects of the Invention

According to the above-described aspects of the present disclosure, a heterojunction composite of the present disclosure forms a composite material in which an anisotropic material such as a chalcogenide metal compound is uniformly dispersed within a substrate, which is an isotropic material, without pores. Since the anisotropic material is dispersed within the substrate, the composite material exhibits surface properties which have not been seen from the existing composite materials.

Further, it is easy to develop a composite material using electrical, structural, optical, thermal, magnetic, and electrochemical properties of the anisotropic material.

The heterojunction composite of the present disclosure can be used as an electrode with high efficiency and stability in a hydrogen evolution reaction (HER), a hydrogen oxidation reaction (HOR), an oxygen reduction reaction (ORR), and an oxygen evolution reaction (OER). Further, the heterojunction composite of the present disclosure can be used in various organic chemical reactions such as methanol reduction.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1A:
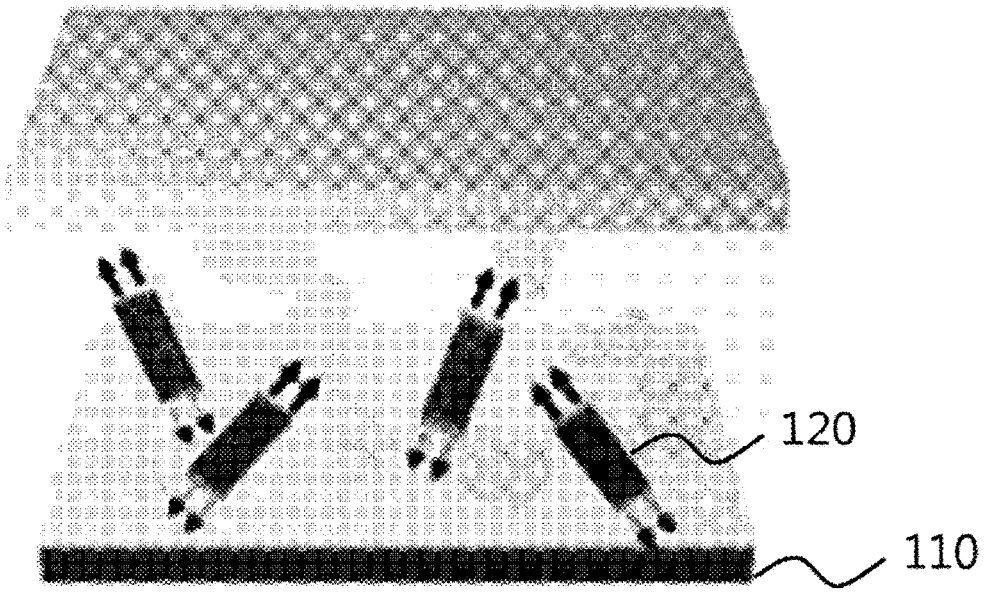
FIG. 1A is a schematic diagram of a heterojunction composite according to an embodiment of the present disclosure.

Hereinafter, embodiments of the present disclosure will be described in detail with reference to the accompanying drawings so that the present disclosure may be readily implemented by those skilled in the art.

However, it is to be noted that the present disclosure is not limited to the embodiments but can be embodied in various other ways. In drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the terms "on", "above", "on an upper end", "below", "under", and "on a lower end" that are used to designate a position of one element with respect to another element include both a case that the one element is adjacent to the other element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise.

Through the whole document, the term "about or approximately" or "substantially" is intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

Through the whole document, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group. Through the whole document, a phrase in the form "A and/or B" means "A or B, or A and B".

Hereinafter, a heterojunction composite and a method of preparing the same of the present disclosure will be described in detail with reference to embodiments and examples and the accompanying drawings. However, the present disclosure may not be limited to the following embodiments, examples and drawings.

According to a first aspect of the present disclosure, there is provided a heterojunction composite including: a chalcogenide metal compound dispersed on a substrate, and all or a part of the substrate is chalcogenized in the same manner as the chalcogenide metal compound.

Figure 1B:
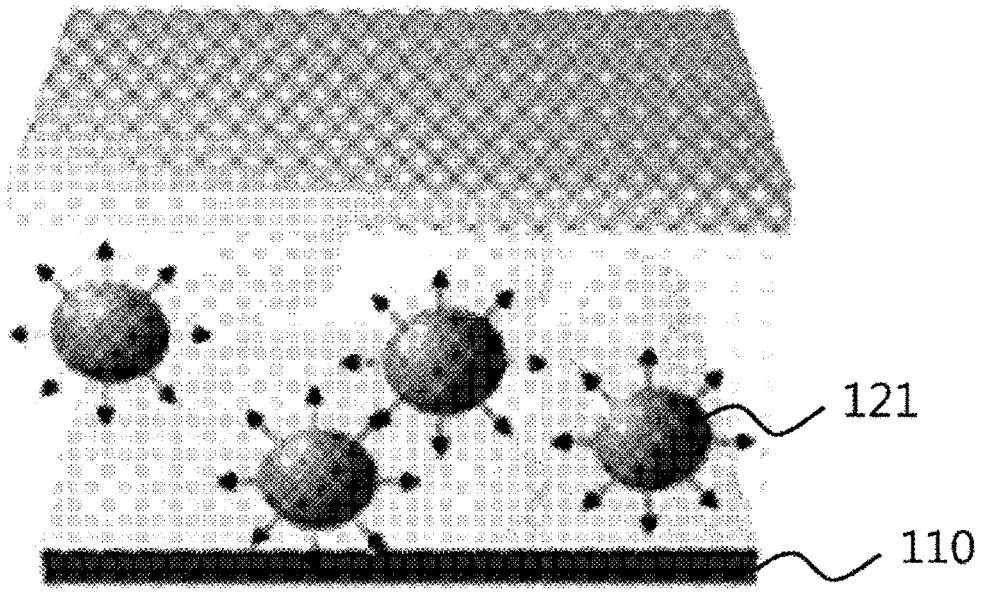
FIG. 1B is a schematic diagram of an existing nanocomposite material.

FIG. 1A is a schematic diagram of a heterojunction composite according to an embodiment of the present disclosure, and FIG. 1B is a schematic diagram of an existing nanocomposite material.

According to an embodiment of the present disclosure, a chalcogenide metal compound 120 may include an anisotropic material, but may not be limited thereto.

The anisotropic material refers to a material having physical properties which vary depending on a direction and having the optimal transmission properties for a specific direction due to a layered structure when electric charges, phonons, or photons pass through the chalcogenide metal compound.

According to an embodiment of the present disclosure, a substrate 110 may include an isotropic material, but may not be limited thereto.

The isotropic material refers to a material having physical properties which are uniform in all directions.

Conventionally, a nanocomposite material in which an anisotropic material is dispersed within a substrate has been formed by synthesizing two or more different materials and performing a heat treatment. During the heat treatment, pores may be formed, and, thus, the internal material may not be uniformly dispersed in the nanocomposite material. In the case where thermal compression is performed to remove the pores, the pores can be removed but a layered structure of a chalcogen compound may be damaged, and, thus, a desired composite material cannot be prepared. However, in the present disclosure, when a chalcogen compound is synthesized, a side reaction is induced to form a dense structure. Therefore, a heterojunction composite in which a layered structure of the chalcogen compound is dispersed in an isotropic material without being damaged can be prepared.

Since the anisotropic material is dispersed within the isotropic substrate without pores, electric charges, phonons, or photons can be transmitted in a medium. Therefore, the properties of the anisotropic material confined in the isotropic substrate can be expressed.

According to an embodiment of the present disclosure, the substrate may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

According to an embodiment of the present disclosure, the chalcogenide metal compound may include a chalcogen selected from the group consisting of S, Se, Te, and combinations thereof, but may not be limited thereto.

According to an embodiment of the present disclosure, the chalcogenide metal compound may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto. The chalcogenide metal compound may be selected from the group consisting of, for example, $MoS_2$, $MnO_2$, $MoO_3$, $MoSe_2$, $MoTe_2$, $WS_2$, $WSe_2$, $MSe_2$, and combinations thereof.

In the heterojunction composite, the chalcogen compound which is an anisotropic material is dispersed within the metal which is an isotropic material. Thus, it is easy to develop a composite material using electrical, structural, optical, thermal, magnetic, and electrochemical properties of the anisotropic material.

The heterojunction composite in which the chalcogen compound as an anisotropic material is dispersed within the metal as an isotropic material can be used as an electrode in a hydrogen evolution reaction (HER).

The heterojunction composite can be used as an electrode with high efficiency and stability in a hydrogen evolution reaction (HER), a hydrogen oxidation reaction (HOR), an oxygen reduction reaction (ORR), and an oxygen evolution reaction (OER). Further, the heterojunction composite of the present disclosure can be used in various organic chemical reactions such as methanol reduction.

According to a second aspect of the present disclosure, there is provided a method of preparing a heterojunction composite, including: supplying a chalcogenide precursor-containing source and a metal precursor-containing source onto a substrate; and chalcogenizing the substrate, and a chalcogen compound is dispersed within the substrate.

Figure 2:
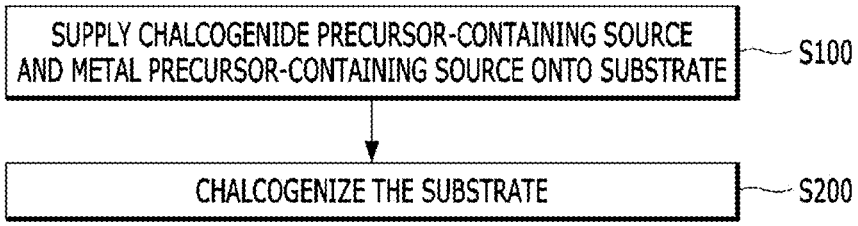
FIG. 2 is a flowchart showing a method of preparing a heterojunction composite according to an embodiment of the present disclosure.

FIG. 2 is a flowchart showing a method of preparing a heterojunction composite according to an embodiment of the present disclosure.

Figure 3:
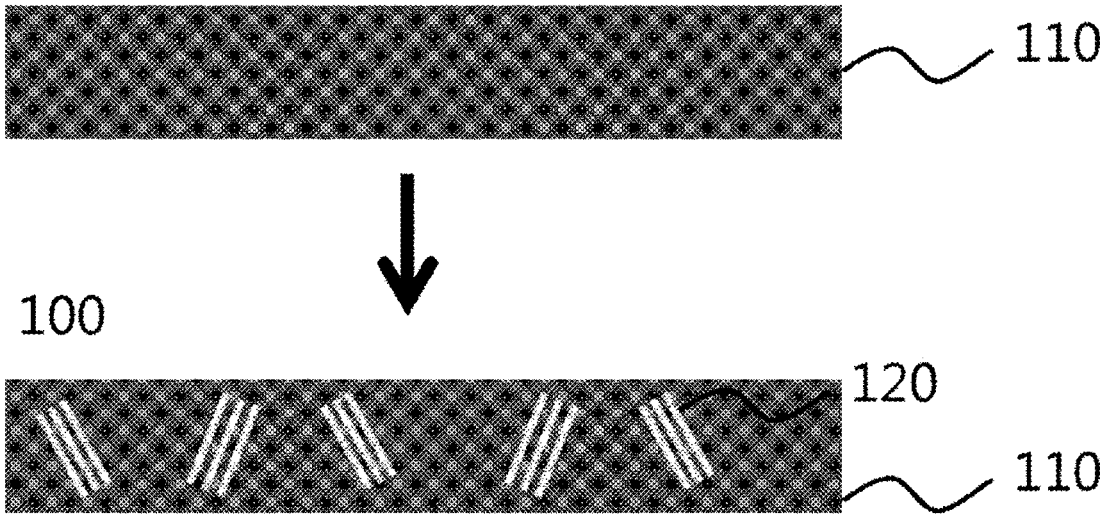
FIG. 3 is a schematic diagram illustrating a method of preparing a heterojunction composite according to an embodiment of the present disclosure.

FIG. 3 is a schematic diagram illustrating a method of preparing a heterojunction composite according to an embodiment of the present disclosure.

Firstly, a chalcogenide precursor-containing source and a metal precursor-containing source are supplied onto a substrate (S100).

The chalcogenide precursor-containing source and the metal precursor-containing source may be moved by a carrier gas, but may not be limited thereto.

The carrier gas may be selected from the group consisting of nitrogen, argon, krypton, helium, xenon, and combinations thereof, but may not be limited thereto.

According to an embodiment of the present disclosure, the chalcogenide metal compound 120 may include an anisotropic material, but may not be limited thereto.

According to an embodiment of the present disclosure, the substrate 110 may include an isotropic material, but may not be limited thereto.

According to an embodiment of the present disclosure, the substrate may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

According to an embodiment of the present disclosure, the chalcogenide precursor-containing source may include a chalcogen selected from the group consisting of S, Se, Te, and combinations thereof, but may not be limited thereto.

The chalcogenide precursor-containing source may include a member selected from the group consisting of, for example, $H_2S$, $H_2Se$, $H_2Te$, and combinations thereof.

According to an embodiment of the present disclosure, the metal precursor-containing source may include a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof, but may not be limited thereto.

The metal precursor-containing source may include a member selected from the group consisting of, for example, $MoCl_5$, $WCl_5$, $CuCl_5$, $NiCl_5$, $TiCl_5$, $VCl_5$, $CrCl_5$, $ScCl_5$, $MnCl_5$, $FeCl_5$, $CoCl_5$, $ZnCl_5$, $YCl_5$, $ZrCl_5$, $NbCl_5$, $TcCl_5$, $RuCl_5$, $RhCl_5$, $PdCl_5$, $AgCl_5$, $CdCl_5$, $HfCl_5$, $TaCl_5$, $ReCl_5$, $OsCl_5$, $IrCl_5$, $PtCl_5$, $AuCl_5$, $HgCl_5$, $RfCl_5$, $DbCl_5$, $SgCl_5$, $BhCl_5$, $HsCl_5$, $MtCl_5$, $DsCl_5$, $RgCl_5$, $CnCl_5$, and combinations thereof.

Then, the substrate 110 is chalcogenized (S200).

The substrate is chalcogenized with the supplied chalcogenide precursor-containing source.

For example, if the substrate 110 is Cu, the chalcogenide precursor-containing source is $H_2S$ and the metal precursor-containing source is $MoCl_5$, when the chalcogenide precursor-containing source and the metal precursor-containing source are supplied onto the substrate 110, the $MoS_2$ chalcogenide metal compound 120 is uniformly dispersed within the chalcogenized $Cu_2S$ substrate 110 to form a heterojunction composite.

Since the substrate 110 is chalcogenized, the chalcogenide metal compound 120 can be uniformly dispersed within the substrate 110.

Hereinafter, the present disclosure will be described in more detail with reference to examples. The following examples are provided only for explanation, but do not intend to limit the scope of the present disclosure.

Example 1

Firstly, a $MoS_2$ chalcogen compound was formed on a copper foil substrate.

In a process for forming the $MoS_2$ chalcogen compound, $MoCl_5$ (99.6%, STREM Chemicals) and $H_2S$ (3.99%, $N_2$, JC Gas) were injected into an ALD chamber at 140° C. and then reacted using a nitrogen gas as both a carrier gas and a purging gas which was injected at a total flow rate of 200 sccm (standard cubic centimeters per minute).

The $MoCl_5$ was injected for 0.5 seconds to 5 seconds and the $H_2S$ was injected for 1 second, and the nitrogen purging was performed for 30 seconds. A chalcogen compound was formed by repeating the cycle 3000 times.

During this process, a part or all of the Cu substrate was chalcogenized with $Cu_2S$ and formed of an isotropic material, and the anisotropic $MoS_2$ chalcogen compound was dispersed within the $Cu_2S$ substrate, which was referred to as a Cu-heterojunction composite.

Example 2

Firstly, a $MoS_2$ chalcogen compound was formed on a copper foil substrate.

In a process for forming the $MoS_2$ chalcogen compound, $MoCl_5$ (99.6%, STREM Chemicals) and $H_2S$ (3.99%, $N_2$, JC Gas) were injected into an ALD chamber at 140° C. and then reacted using a nitrogen gas as both a carrier gas and a purging gas which was injected at a total flow rate of 200 sccm (standard cubic centimeters per minute).

The $MoCl_5$ was injected for 0.5 seconds to 5 seconds and the $H_2S$ was injected for 1 second, and the nitrogen purging was performed for 30 seconds. A chalcogen compound was formed by repeating the cycle 3000 times.

The copper substrate on which the $MoS_2$ chalcogen compound was formed was heat-treated at 500° C. for 1 hour.

Then, $TiO_2$ was deposited on the heat-treated copper substrate by ALD. Specifically, titanium isopropoxide was injected as a metal reactant at 70° C. for 2 seconds, and water was injected as an oxide source at room temperature for 2 seconds. Further, an argon gas was injected and deposited as a purging gas at 200 sccm for 8 seconds.

The prepared sample was heat-treated and then referred to as a Cu-heterojunction composite/$TiO_2$.

Example 3

Firstly, porous nickel foam was sonicated in ethanol for 30 minutes and then heat-treated at 800° C. for 2 hours under the reducing atmosphere with a mixture gas of 5% $H_2$ and Ar.

A $MoS_2$ chalcogen compound was formed on the nickel foam.

In a process for forming the $MoS_2$ chalcogen compound, $MoCl_5$ (99.6%, STREM Chemicals) and $H_2S$ (3.99%, $N_2$, JC Gas) were injected into an ALD chamber at 140° C. and then reacted using a nitrogen gas as both a carrier gas and a purging gas which was injected at a total flow rate of 200 sccm (standard cubic centimeters per minute).

The $MoCl_5$ was injected for 0.5 seconds to 5 seconds and the $H_2S$ was injected for 1 second, and the nitrogen purging was performed for 30 seconds. A chalcogen compound was formed by repeating the cycle 3000 times.

During this process, a part or all of the Ni substrate was chalcogenized with $Ni_2S$ and formed of an isotropic material, and the anisotropic $MoS_2$ chalcogen compound was dispersed within the $Ni_2S$ substrate, which was referred to as a Ni-heterojunction composite.

Test Example

The properties of the Cu-heterojunction composite prepared in Example 1 were observed and the result thereof was as shown in FIG. 4.

Figure 4A:
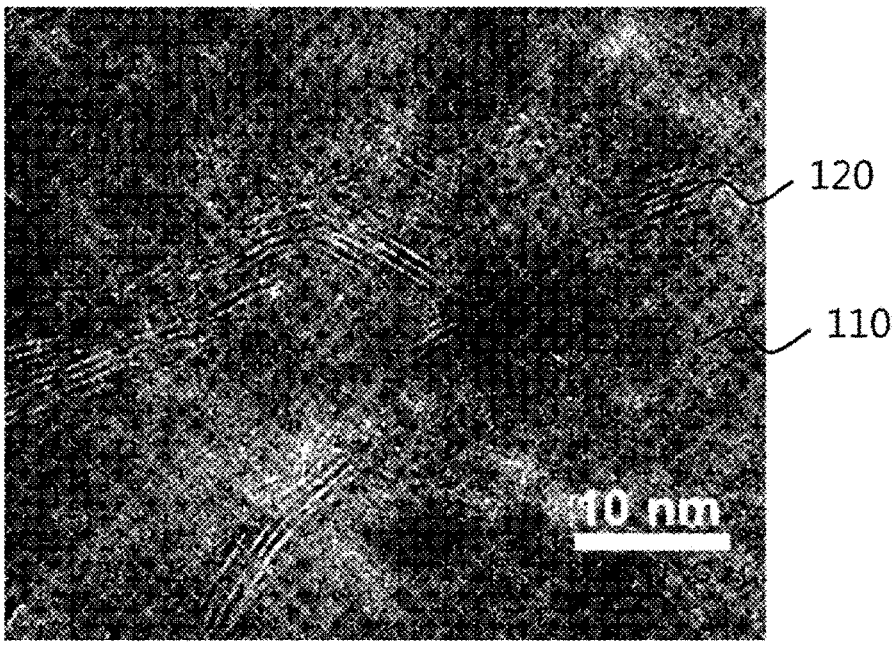
FIG. 4A is a scanning electron microscopy (SEM) image of a Cu-heterojunction composite according to an example of the present disclosure.
Figure 4B:
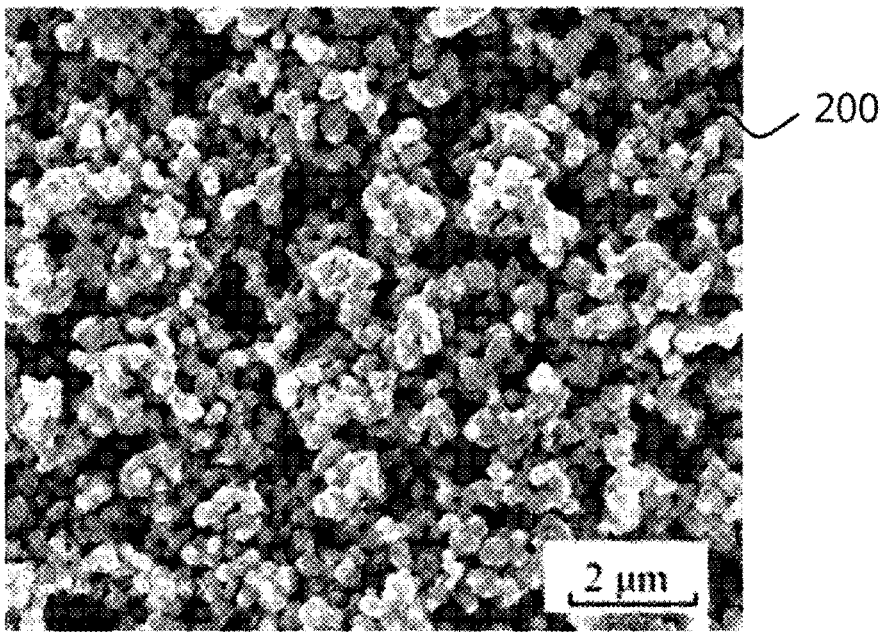
FIG. 4B is a SEM image showing a cross section of an existing composite material.

FIG. 4A is a scanning electron microscopy (SEM) image of a Cu-heterojunction composite, and FIG. 4B is a SEM image showing a cross section of an existing composite material.

According to the result shown in FIG. 4, a chalcogen compound is densely formed into a layered structure in the Cu-heterojunction composite, whereas pores are formed in the existing composite material. In the case where thermal compression is performed to remove the pores, the pores can be removed but the layered structure of the chalcogen compound may be damaged, and, thus, a desired composite material cannot be prepared. However, in the Cu-heterojunction composite, the layered structure of the chalcogen compound is dispersed in the isotropic Cu substrate without being damaged.

Figure 5:
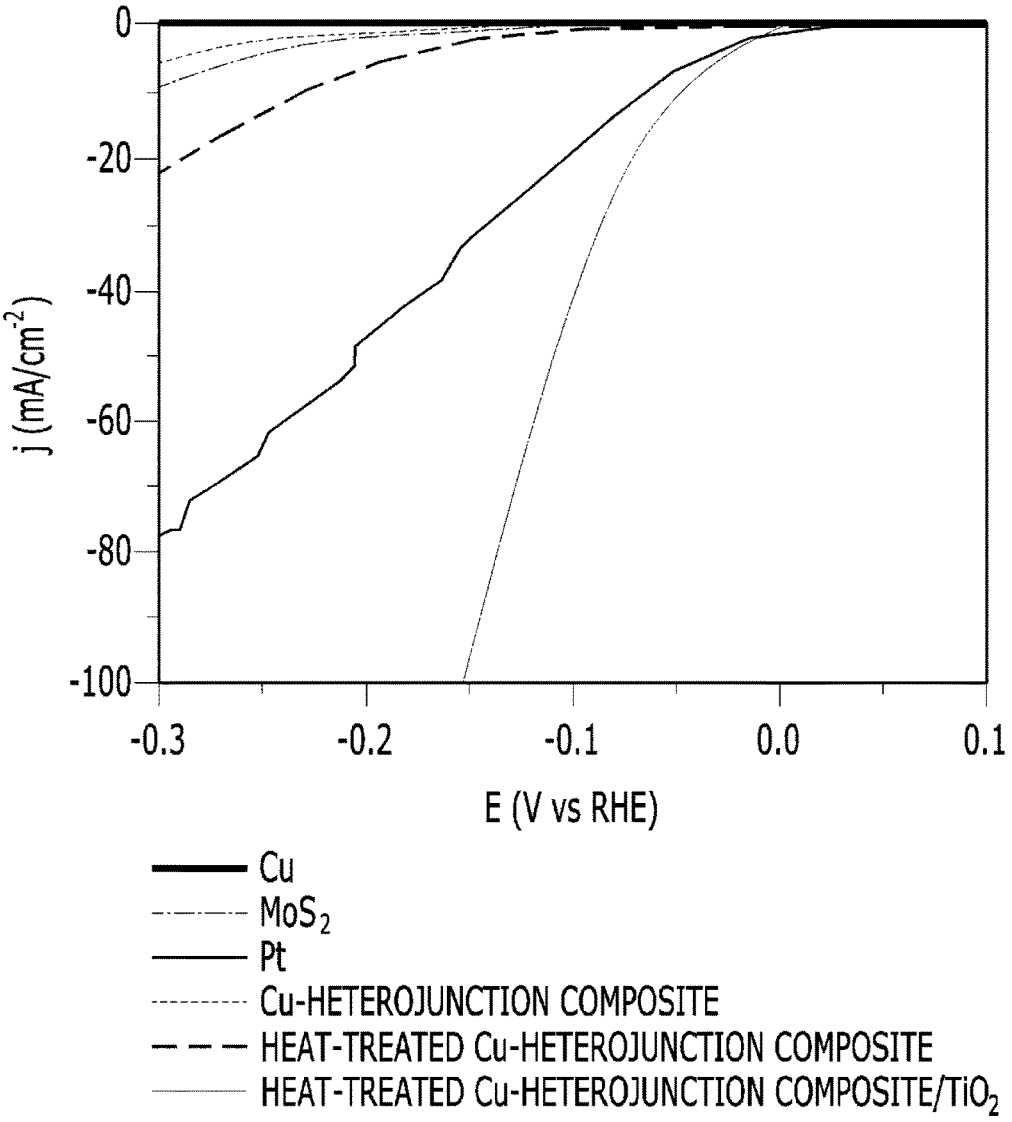
FIG. 5 shows polarization curves for Cu, $MoS_2$, Pt, Cu-heterojunction composite, heat-treated Cu-heterojunction composite, and heat-treated Cu-heterojunction composite/$TiO_2$ according to an example of the present disclosure.
Figure 6:
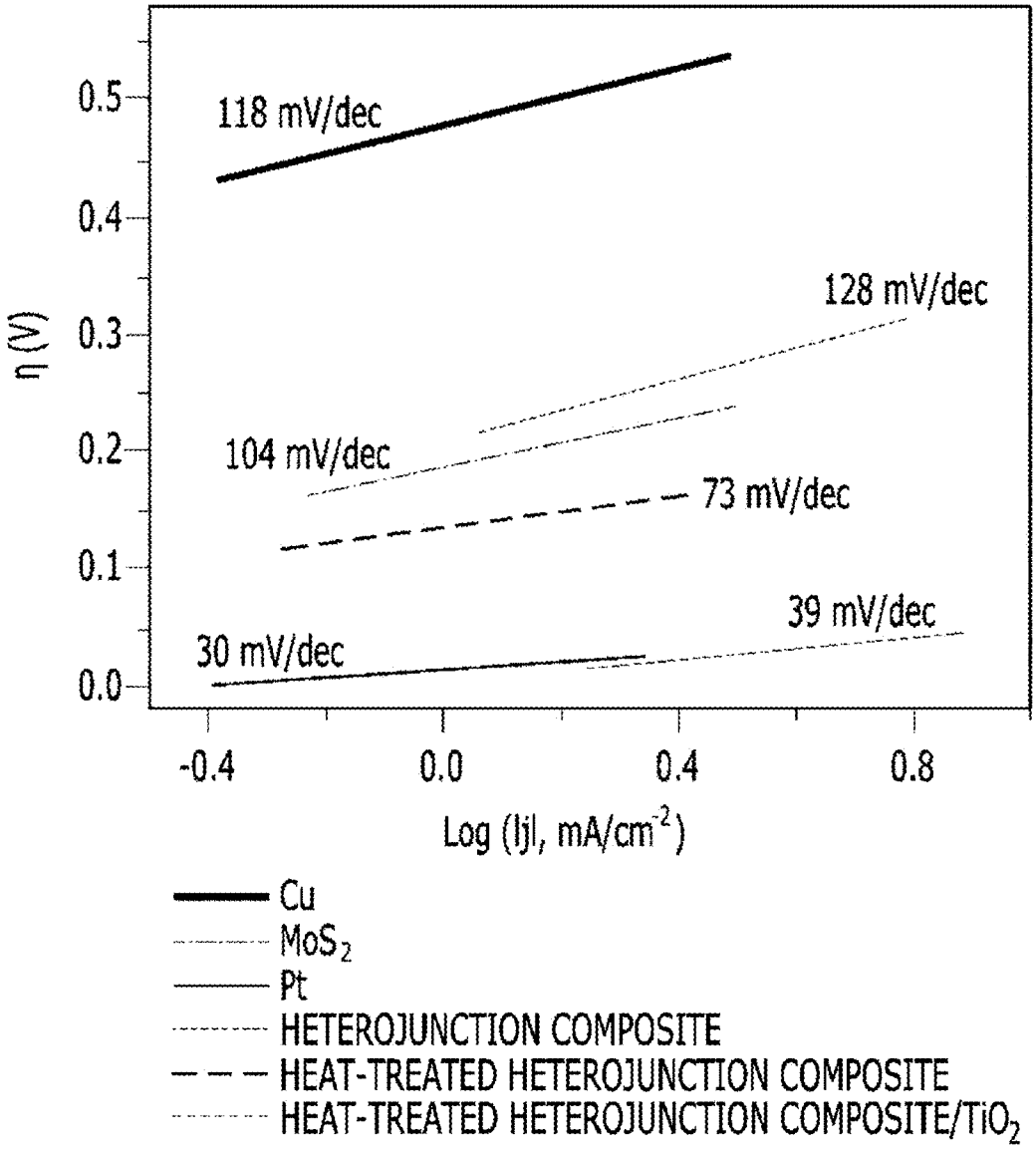
FIG. 6 shows Tafel curves for Cu, $MoS_2$, Pt, Cu-heterojunction composite, heat-treated Cu-heterojunction composite, and heat-treated Cu-heterojunction composite/$TiO_2$ according to an example of the present disclosure.
Figure 7:
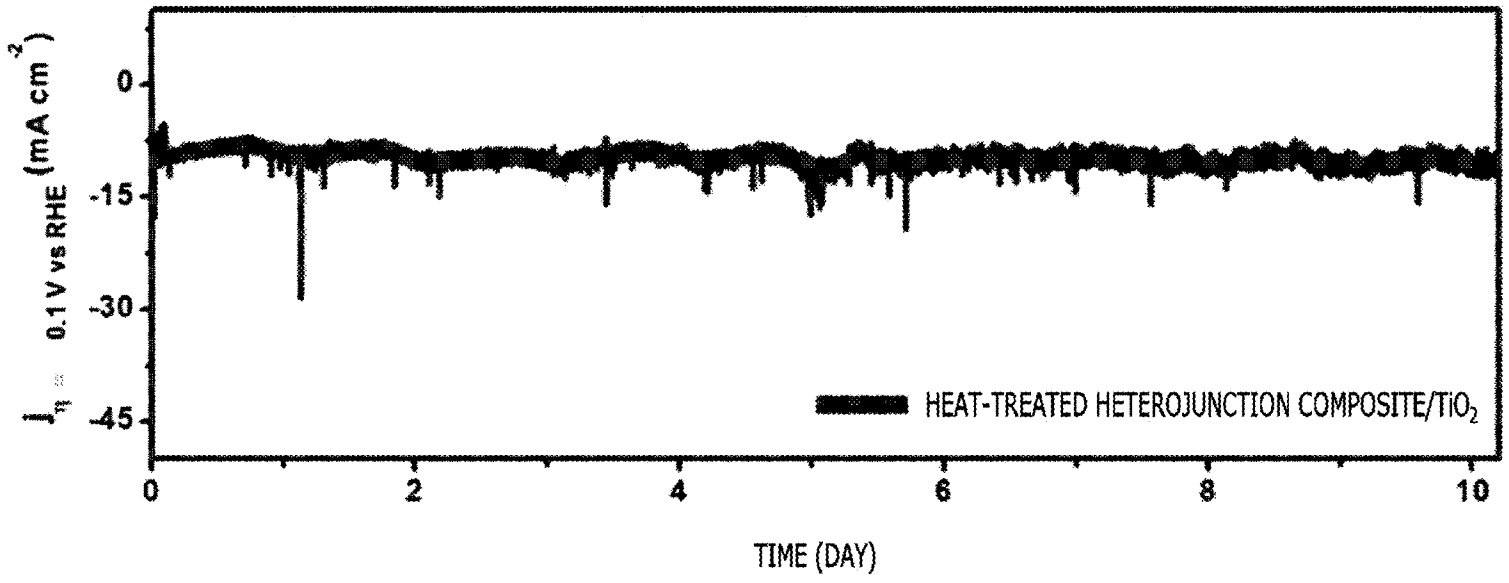
FIG. 7 is a time (day)-dependent graph showing a current density value of heat-treated Cu-heterojunction composite/$TiO_2$ at −0.1 V according to an example of the present disclosure.

The HER (hydrogen evolution reaction) properties of the Cu-heterojunction composite and the heat-treated Cu-heterojunction composite/$TiO_2$ prepared in Example 1 and Example 2 were measured using a potentiostat (VMP-300, Bio-Logic), and the result thereof was as shown in FIG. 5 to FIG. 7.

Specifically, the Cu-heterojunction composite was used as a cathode, Pt was used as an anode, Ag/AgCl was used as a reference electrode, and sulfuric acid was used as an electrolyte. Further, $TiO_2$ was deposited to protect the cathode.

FIG. 5 shows polarization curves for Cu, $MoS_2$, Pt, Cu-heterojunction composite, heat-treated Cu-heterojunction composite, and heat-treated Cu-heterojunction composite/$TiO_2$ according to an example of the present disclosure.

FIG. 6 shows Tafel curves for Cu, $MoS_2$, Pt, Cu-heterojunction composite, heat-treated Cu-heterojunction composite, and heat-treated Cu-heterojunction composite/$TiO_2$ according to an example of the present disclosure.

Specifically, FIG. 6 is a graph obtained by replotting the graph shown in FIG. 5 as the overpotential (η) versus logarithmic current density.

According to the result shown in FIG. 5 and FIG. 6, the HER activity was high in order of the Cu-heterojunction composite, the heat-treated Cu-heterojunction composite, and the heat-treated Cu-heterojunction composite/$TiO_2$. Particularly, the Cu-heterojunction composite/$TiO_2$ shows the HER activity similar to that of Pt mainly used in HER and thus can be considered as an alternative material in HER. Further, $TiO_2$ can be considered as being used to protect the cathode and increase the HER activity.

FIG. 7 is a time (day)-dependent graph showing a current density value of heat-treated Cu-heterojunction composite/$TiO_2$ at −0.1 V.

According to the result shown in FIG. 7, it can be seen that a current density of the heat-treated Cu-heterojunction composite/$TiO_2$ is very stable with little change over time.

Figure 8:
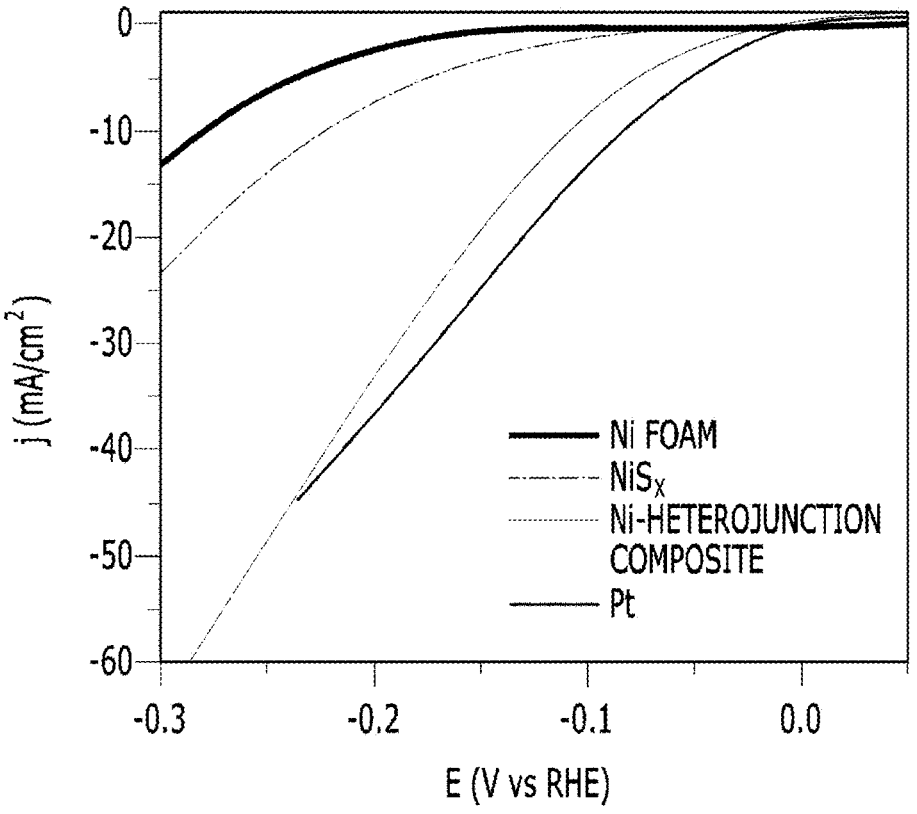
FIG. 8 shows polarization curves for Ni foam, NiSx, Ni-heterojunction composite, and Pt according to an example of the present disclosure.
Figure 9:
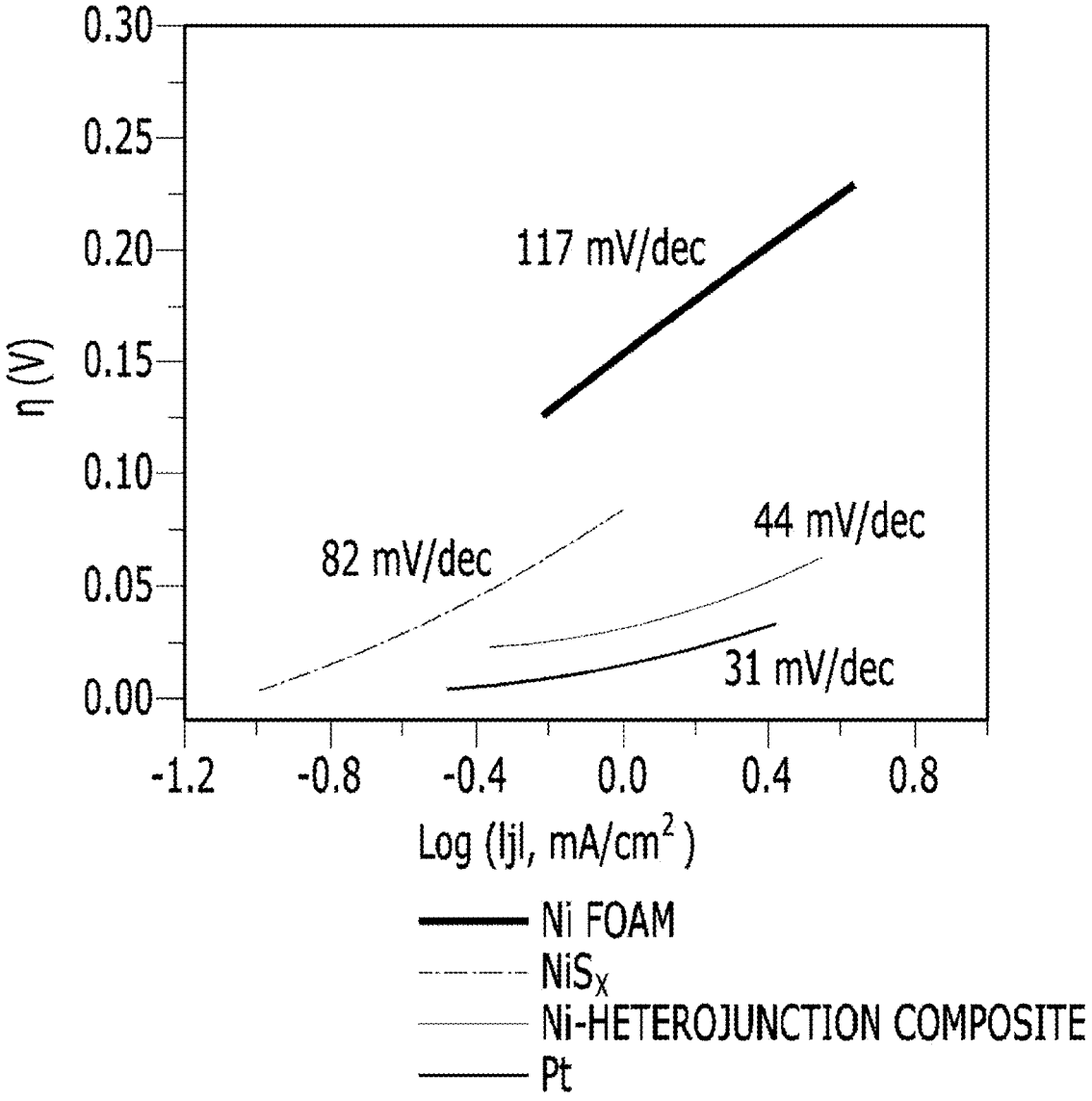
FIG. 9 shows Tafel curves for Ni foam, NiSx, Ni-heterojunction composite, and Pt according to an example of the present disclosure.
Figure 10:
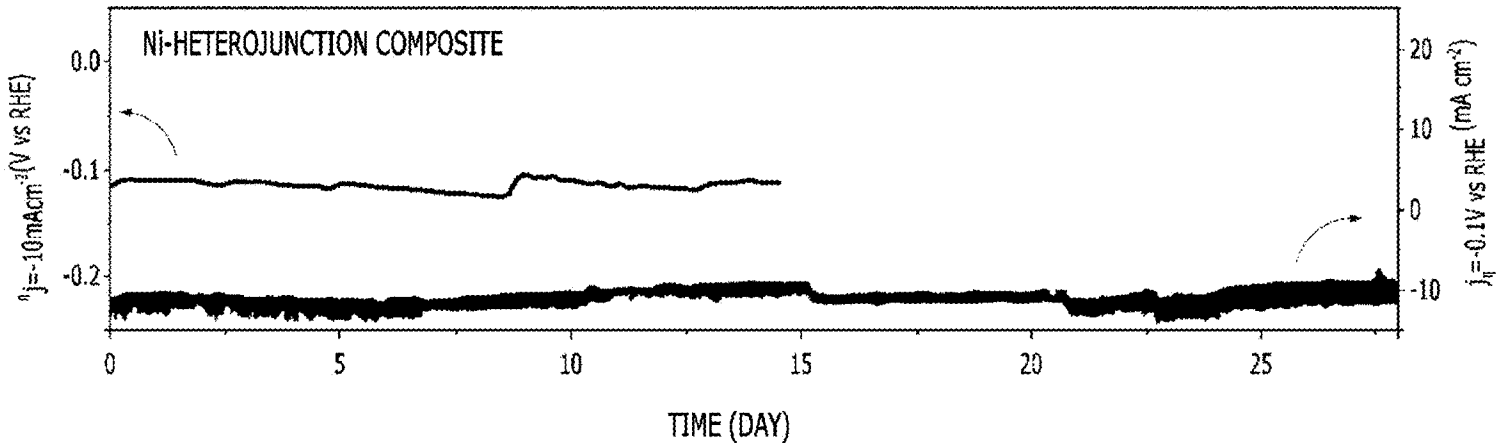
FIG. 10 shows a time-dependent graph showing a voltage value (black line) of Ni-heterojunction composite at 10 $mA/cm^2$ and a current density value (red line) at 0.1 V according to an example of the present disclosure.

The HER (hydrogen evolution reaction) properties of the Ni-heterojunction composite prepared in Example 3 were measured using a potentiostat (VMP-300, Bio-Logic), and the result thereof was as shown in FIG. 8 to FIG. 10.

Specifically, the Ni-heterojunction composite was used as a working electrode, the Ni-heterojunction composite and Pt were used a counter electrode, and a saturated calomel electrode (SCE) was used as a reference electrode.

FIG. 8 shows polarization curves for Ni foam, NiSx, Ni-heterojunction composite, and Pt according to an example of the present disclosure.

FIG. 9 shows Tafel curves for Ni foam, NiSx, Ni-heterojunction composite, and Pt according to an example of the present disclosure.

Specifically, FIG. 9 is a graph obtained by replotting the graph shown in FIG. 8 as the overpotential (η) versus logarithmic current density.

According to the result shown in FIG. 8 and FIG. 9, the Ni-heterojunction composite shows the HER activity similar to that of Pt mainly used in HER and thus can be considered as an alternative material in HER.

Further, it can be seen that like the Cu-heterojunction composite, a heterojunction composite in which an anisotropic chalcogen compound is dispersed in an isotropic metal shows an effect in HER.

FIG. 10 shows a time-dependent graph showing a voltage value (black line) of Ni-heterojunction composite at 10 $mA/cm^2$ and a current density value (red line) at 0.1 V. According to the result shown in FIG. 10, it can be seen that a voltage and a current density of the Ni-heterojunction composite are very stable with little change over time.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

EXPLANATION OF REFERENCE NUMERALS

100: Heterojunction composite
110: Substrate
120: Chalcogenide metal compound
121: Isotropic material
200: Pore

We claim:

1. A heterojunction composite, comprising:
a layered structure of a chalcogenide metal compound dispersed on a substrate,
wherein all or a part of the substrate is chalcogenized in the same manner as the chalcogenide metal compound,
wherein the chalcogenide metal compound includes an anisotropic material, and
wherein the substrate includes an isotropic material.

2. The heterojunction composite of claim 1,
wherein the substrate includes a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof.

3. The heterojunction composite of claim 1,
wherein the chalcogenide metal compound includes a chalcogen selected from the group consisting of S, Se, Te, and combinations thereof.

4. The heterojunction composite of claim 1,
wherein the chalcogenide metal compound includes a metal selected from the group consisting of Cu, Ni, Sc, Ti, V, Cr, Mn, Fe, Co, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg, Cn, and combinations thereof.

* * * * *